US006064315A

United States Patent [19]

Orlassino et al.

[11] Patent Number: 6,064,315

[45] Date of Patent: May 16, 2000

[54] ZERO SPEED TRANSDUCER

[75] Inventors: Mark P. Orlassino, Centereach; Irwin Weitman, East Northport, both of N.Y.

[73] Assignee: Harmon Industries, Inc., Blue Springs, Mo.

[21] Appl. No.: 09/222,147

[22] Filed: Dec. 29, 1998

[51] Int. Cl.[7] ..... G08B 21/00

[52] U.S. Cl. ..... 340/686.1; 340/686.3; 340/441; 340/445; 246/249

[58] Field of Search ..... 340/686.1, 686.2, 340/686.3, 441, 444, 545.1; 324/179, 225, 233, 239, 241; 246/169 R, 249

[56] References Cited

U.S. PATENT DOCUMENTS

| | | | |
|---|---|---|---|
| 3,210,539 | 10/1965 | Malaquin | 246/249 |
| 3,844,513 | 10/1974 | Bernhardson et al. | 246/169 R |
| 5,214,427 | 5/1993 | Yano | 341/20 |
| 5,333,820 | 8/1994 | Gilcher | 246/249 |
| 5,395,078 | 3/1995 | Gellender | 246/249 |
| 5,430,278 | 7/1995 | Krieg et al. | 235/449 |
| 5,628,478 | 5/1997 | McConnel et al. | 246/149 |
| 5,691,640 | 11/1997 | King | 324/233 |

*Primary Examiner*—Jeffery A. Hofsass
*Assistant Examiner*—Van T. Trieu
*Attorney, Agent, or Firm*—Chase & Yakimo, L.C.

[57] ABSTRACT

Detection of a zero speed or moving railway vehicle wheel or other metallic object is accomplished by providing a balanced E-core inductive detector. An exciter coil on the center leg of the E-core inductively couples a pair of sensor coils connected in series opposition on the outside legs of the E-core. A voltage detector responsive to unbalancing of the E-core magnetic field by a train wheel or other metallic object is connected to the output of the sensor coils. A zero speed wheel located at the center of the magnetic field is detected by using the output of one of the sensor coils compared with the phase shifted and amplitude adjusted exciter signal. Speed and direction of travel are also determined by monitoring wheel detection output sequencing and timing.

14 Claims, 5 Drawing Sheets

ZERO SPEED TRANSDUCER

BACKGROUND OF THE INVENTION

This invention relates to a method and apparatus for improving the capability and reliability of systems for detecting the presence, speed, and direction of movement of a metallic object and, in particular, a railway vehicle by improving the ability to detect a vehicle wheel both when moving and at zero speed.

Transducers are used to detect the wheels of a moving railway vehicle to activate automatic gates at railroad crossings or determine the exact position of a railway vehicle for the transfer of a load from a railway car to a collection site. One such detector is disclosed in U.S. Pat. No. 5,395,078 to Gellender. One problem with the wheel transducer described in the Gellender patent has been that the transducer cannot detect a wheel stopped at the magnetic center of the two coils. A further problem with prior art transducers has been the need to calibrate periodically due to baseline voltage drift caused by temperature variations, vibration, and debris, which effect the performance of the transducer components. A system tolerant to this drift is particularly important to a zero speed transducers.

SUMMARY OF THE INVENTION

It is, therefore, the primary object of the present invention to provide a method and apparatus for detecting a metallic object such as a railway vehicle wheel in the vicinity of the sensor whether the metallic object is stationary or in motion.

It is also an important object of the present invention to provide a method and apparatus for determining the position of the metallic object relative to the center of the sensor whether the metallic object is stationary or in motion.

Another important object of the present invention is to provide such a method and apparatus employing an inductive detector that utilizes balanced sensing coils for increased detection sensitivity and immunity to magnetic field variations induced by electrical current flow through the rail.

Still another important object is to provide a method and apparatus as aforesaid which is capable of reliably detecting the presence of a zero speed wheel in instances where the wheel comes to rest at a magnetic center of the sensing system.

Still another object is to provide a method and apparatus for detecting a train wheel, which is not susceptible to environmental variations.

Yet another object is to provide a method and apparatus for detecting a train wheel that does not require post-installation calibration for detecting a train wheel.

These and other objects of the invention are achieved by applying a drive voltage to an exciter coil of a balanced open E-core transformer which inductively couples the exciter coil with a pair of sensing coils connected in series opposition. An output of the sensing coils is connected to a synchronous detector, which is responsive to unbalancing of the magnetic field in the presence of a wheel. Because a wheel located at the magnetic center of the sensor does not disturb this balance, a second output is derived from the summation of the induced voltage in one of the sense coils and the phase and amplitude adjusted output from the drive coil voltage. This second output is altered by a metallic object located at the magnetic center of the structure. The outputs from the exciter coil and one of the sensing coils are connected to a second synchronous detector and low pass filter which is responsive to a phase and amplitude having exceeded a preset threshold when a train wheel is stopped at the magnetic center of the E-core. Thus, a wheel located in proximity to said sensor coil is detected and this signal is logically combined with the balanced sensor output to provide an unambiguous indication of the presence of a wheel at the magnetic center of the zero speed transducer.

Although the present invention is not limited to the detection of a railway vehicle wheel, the preferred embodiment will be described using the example of a railway vehicle wheel.

More particularly, an approximately 10-volt, 15 kilohertz signal is applied to the exciter coil located on the center leg of the E-core transformer. In the preferred embodiment, the frequency of approximately 15 kHz is selected to avoid conflicts and interference with other electronic track equipment, although other frequencies are functionally acceptable.

The magnetic field induced in the center leg of the E-core follows the path of the E-core and splits into two paths creating nearly identical fields in the two outer legs. Identical sensor coils on the outer legs of the E-core enclose these equal magnetic lines of force and each has a nominally identical voltage induced in it. Thus, when the E-core is open and no magnetic or conductive material such as a train wheel is in the magnetic field, identical voltages are induced in each sensing coil winding. Because the sensing coils are connected in series opposition, the signals in the sensing coils are subtracted to generate a resultant difference voltage of zero, which represents the difference in the magnetic fields of the two outer legs of the transformer. The resultant signal is fed to a synchronous detector, which detects the in-phase component of the signal. The output of the synchronous detector followed by a low pass filter is connected to positive and negative threshold comparators. Thus, if no wheel is present, the outputs of the threshold comparators are logic "FALSE".

When a magnetically lossy train wheel is present in the magnetic field and has more of its mass over one leg of the transformer than the other, unequal voltages are induced in each sensor coil winding. The hysteresis and eddy current losses of the train wheel unbalance the magnetic field and therefore the phase and amplitude of the output from the sensing coils. The synchronous detector is used to produce an output whose average DC value is indicative of the presence of a lossy material in either leg of the transformer. The resultant voltage representing the difference in the losses in the magnetic paths of the two outer legs of the transformer is non-zero. Thus, the average voltage output of the synchronous detector is either positive or negative, depending on which sensor coil is closer to the wheel, triggering either the positive or negative threshold comparators respectively and the position of the lossy material (wheel) is determined.

If, for example, a railroad track is running north-south such that sensor coil 1 is north of sensor coil 2, mounted parallel to the track, a train wheel located closer to sensor coil 1 will produce a positive average voltage output from the synchronous detector triggering the positive threshold comparator. If the train wheel is located closer to sensor coil 2, the output voltage of the synchronous detector will be a negative average voltage triggering the negative threshold comparator. The comparators are set to a level that will minimize false alarms yet indicate the presence of a stationary or moving wheel.

If a train wheel stops at the magnetic center of the E-core, the voltage induced in each of the sensor coils is of equal amplitude and opposite phase and thus the resultant summation voltage is zero, indicating that no wheel is present. In order to differentiate between a wheel located at the exact magnetic center of the detector and no wheel in the field, a voltage is derived from one of the sensor coils and subtracted from a voltage derived from the exciter coil voltage. The phase and amplitude difference of these voltages is measured and component values are adjusted so as to produce a null summation when no metallic material is present in the magnetic field. Then, if any lossy material is introduced, the difference voltage is no longer zero and after amplification and synchronous detection, this signal is used to logically determine that a train wheel is located at the magnetic center of the core.

DETAILED DESCRIPTION

Figure 1:
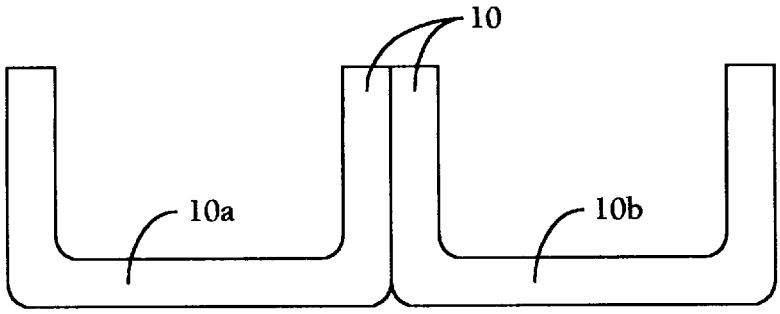
FIG. 1 is an side view of an E-core showing C-core halves.
Figure 2:
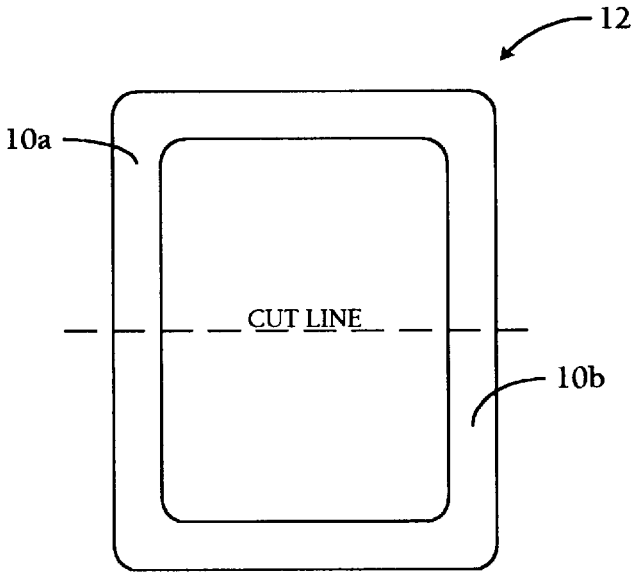
FIG. 2 is an side view of a tape wound bobbin core.

Turning more particularly to the drawings, FIG. 1 illustrates an E-core 10 consisting of two C-cores 10*a* and 10*b*. As illustrated in FIG. 2, C-cores 10*a* and 10*b* are formed by cutting a grain oriented steel laminate tape wound core 12 in half so that the C-cores 10*a* and 10*b* have matched electrical and physical characteristics. These core halves are treated as a matched set and are kept together throughout the assembly process.

Figure 3:
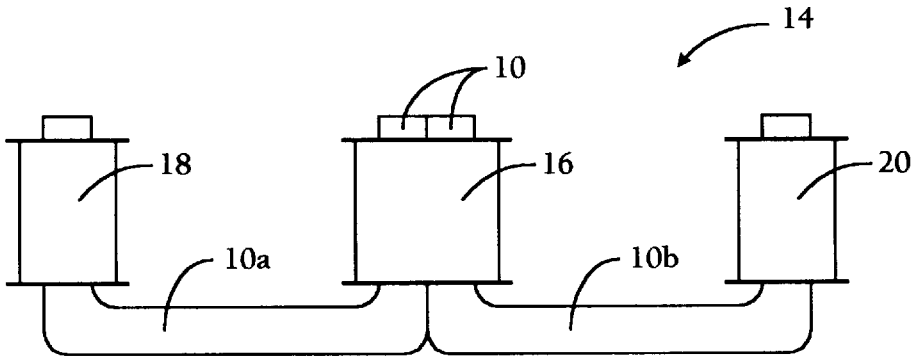
FIG. 3 is an side view of an E-core detection transformer with exciter coil and sensor coils in place.

Transformer 14, shown in FIG. 3, consists of an exciter coil 16, a first sense coil 18, a second sense coil 20 and E-core 10. Exciter coil 16 and sense coils 18 and 20 are wound on nylon bobbins (or other suitable material).

Sense coils 18 and 20 are fabricated to exhibit matched electrical characteristics such that equal magnetic fields in the outer legs of the transformer induce voltages of equal phase and amplitude in each of coils 18 and 20. When an AC voltage source drives exciter coil 16 it produces a magnetic field that splits equally into the two legs of the transformer. Thus, there are equal voltages induced in coils 18 and 20. In the absence of metallic or magnetic induced interactions, the resultant output voltages of sense coils 18 and 20 are equal. When the sense coils are connected in series opposite phase, the output voltage of the series combination is zero and thus presents a balanced condition.

Figure 4:
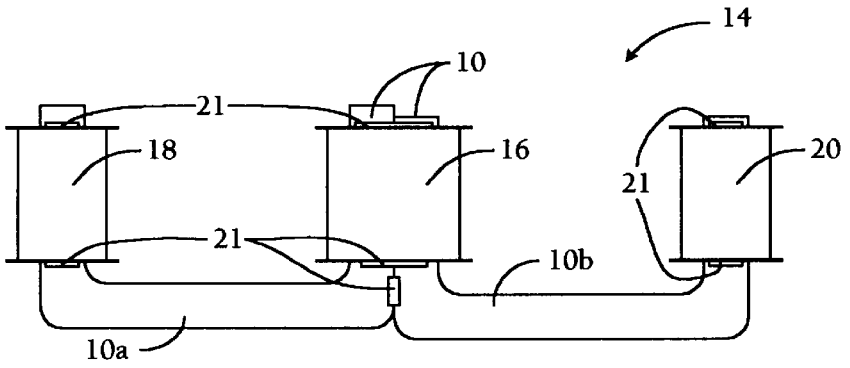
FIG. 4 is an side view of an E-core detection transformer after balancing.

However, because C-cores 10*a* and 10*b* and sense coils 18 and 20 have slight electrical and mechanical variations, detection transformer 14 is "fine" balanced by mechanically adjusting C-cores 10*a* and 10*b*, exciter coil 16, and one of sense coils 18 or 20 as shown in FIG. 4.

C-cores 10*a* and 10*b* are adjusted with respect to each other along the center leg (in the vertical direction as seen in FIG. 4), and the vertical displacement of exciter coil 16 and one of sense coils 18 or 20 is adjusted until the electrically balanced condition is achieved. Once a balanced condition is achieved, the assembly of detection transformer 14 is secured into place to prevent movement (such as by application of an epoxy cement 21). Balancing of detector transformer 14 is important so that installation in the field is simplified by reducing field calibration to mechanical adjustments of the detector mounting to the rail.

Figure 5:
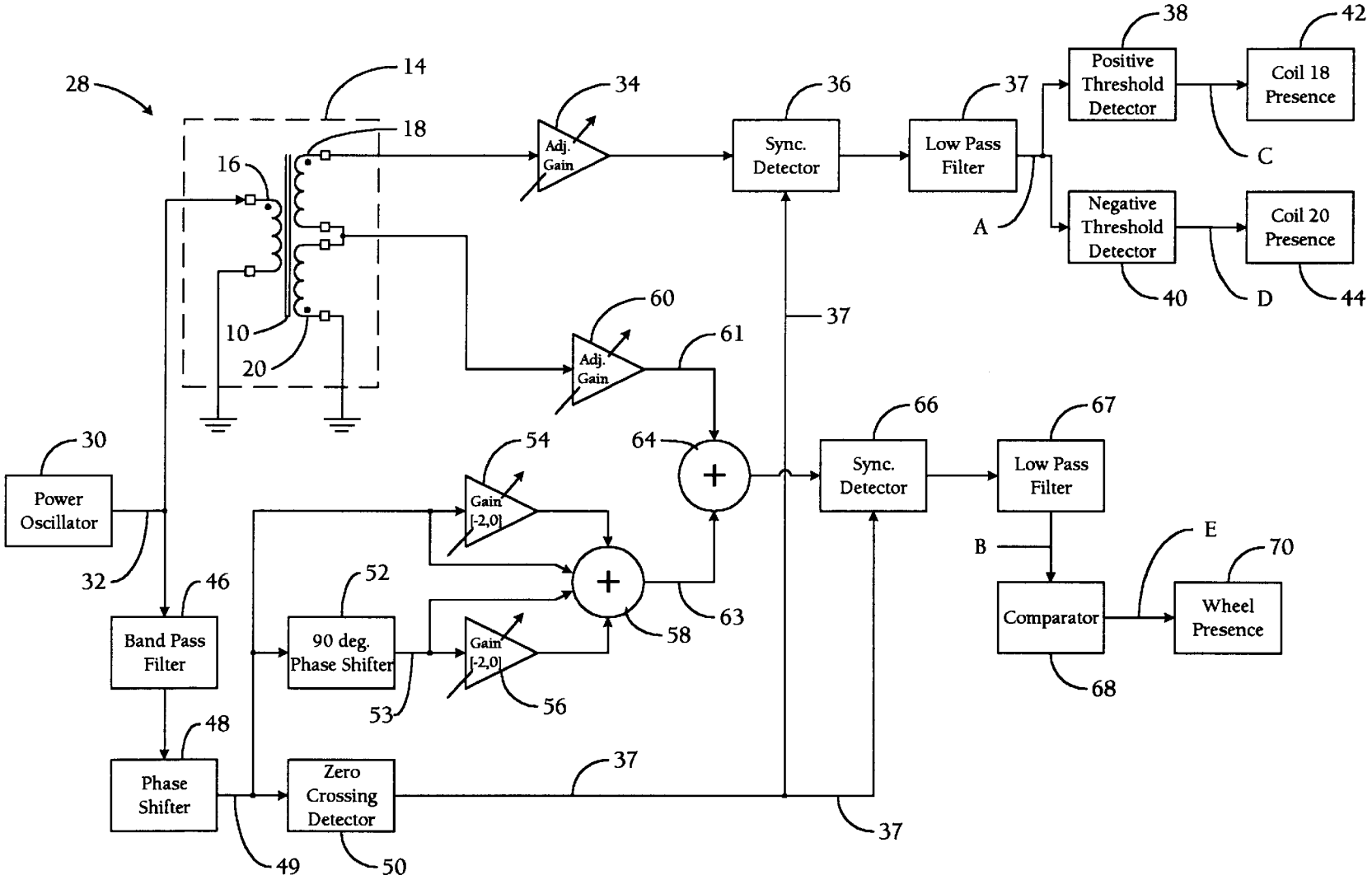
FIG. 5 is a block diagram of the zero speed transducer detection circuit.
Figure 8:
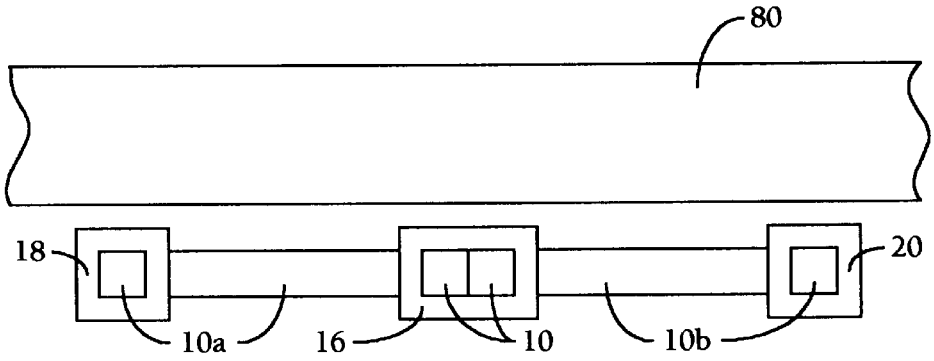
FIG. 8 is a top view of an E-core detection transformer showing relative alignment with a rail.
Figure 9:
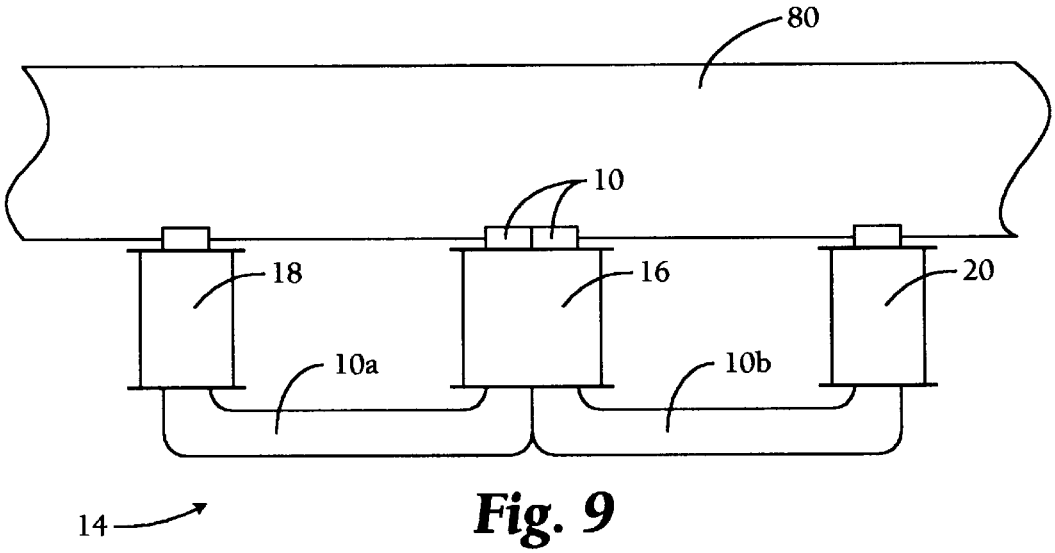
FIG. 9 is an side view of an E-core detection transformer showing relative alignment with a rail.
Figure 10:
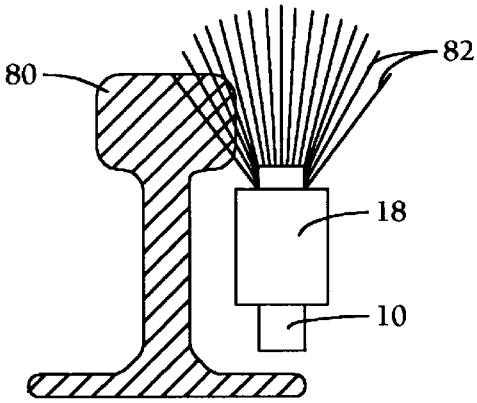
FIG. 10 is a diagrammatic end view of an open E-core detection transformer showing magnetic force lines.
Figure 11:
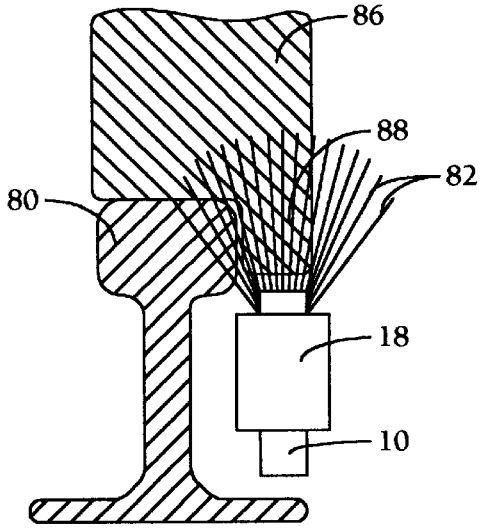
FIG. 11 is a diagrammatic end view of an E-core detection transformer showing magnetic force lines in the presence of a train wheel.

FIG. 5 illustrates a zero speed transducer (ZST) 28 driven by a 15 kHz sine wave produced by power oscillator 30. The output 32 of oscillator 30 is amplitude stabilized to a level between 9 and 18 volts. The actual frequency and voltage is not critical, only its stability is important. Keeping the frequency low reduces core losses of detection transformer 14 and increases the overall sensitivity of ZST 28. Since operation of the ZST 28 is not dependent on the frequency, accuracy or drift the frequency is not controlled.

Output of power oscillator 30 drives exciter coil 16, which is inductively coupled to sense coils 18 and 20. Sense coils 18 and 20 are connected in series opposition to produce a resulting output signal that is amplified by amplifier 34 and fed into synchronous detector 36. Synchronous detector 36 is synchronized to the oscillator-derived signal on line 37, which is in phase with the resistive coupling losses of the lossy magnetic core. Thus, if the average of the summed output of sense coil 18 and sense coil 20 is a positive voltage, the low pass filtered output (A) of synchronous detector 36 is a positive voltage and the positive threshold comparator 38 is triggered (logic level TRUE). If the average output of sense coil 18 and sense coil 20 is a negative voltage, the filtered output of synchronous detector 36 is a negative voltage and negative threshold comparator 40 is triggered (TRUE).

The condition of a TRUE logic signal from either comparator 42 or comparator 44 indicates the presence of a train wheel in proximity to either coil 18 or 20. Since a train wheel located directly at the magnetic center of the sensor will produce logic FALSE outputs from comparators 42 and 44, a similar detection technique is used to determine the presence of the wheel at the magnetic center of the sensor to derive a signal to indicate the presence of a wheel proximate to coil 20. This is accomplished by summing the output of coil 20 with a signal derived from the drive voltage of coil 16. The resulting vector sum of these two voltages when synchronously detected 66 and averaged, produces a DC voltage (signal B), which is applied to comparator 68, which in turn produces a TRUE logic level when the vector sum exceeds a predetermined level. This logic level indicates the presence of a wheel at the magnetic center of the sensor.

The presence detection process is accomplished by amplifying the output signal from coil 20 by amplifier 60. This signal is applied to summer 64 where it is summed with the coil drive voltage 32 that has been phase shifted to be 180 degrees out of phase with the output 61 of amplifier 60 and of equal amplitude.

The phase and amplitude of the 15 kHz drive voltage output 32 is also passed through a 15 kHz bandpass filter 46 (to reduce noise and distortion), and phase shifter 48. This clean 15 kHz sine wave reference signal output 49, is passed on to zero crossing detector 50 which produces the 15 kHz square wave signal on line 37 to drive synchronous detectors 36 and 66.

Reference signal output 49 is also connected to adjustable gain inverting amplifier 54 and summer 58. The output of amplifier 54 and reference signal output 49 are summed by summer 58. The gain of 54 is adjusted to obtain a null output for this in-phase signal when there is no lossy metallic object in the magnetic field. Similarly, reference signal output 49 is connected to 90-degree phase shifter 52. Output 53 of phase shifter 52 is connected to adjustable gain inverting amplifier. The output of inverting amplifier 56 and the signal at 53 are then fed to summer 58. These two signals are summed in the summer 58. The gain of amplifier 56 is adjusted to obtain a null output for this quadrature phase signal when there is no metallic object in the magnetic field. Thus, by adjusting the outputs of amplifiers 54 and 56, the output of summer 58 is adjusted to produce a 15 kHz sine wave that is 180 degrees out of phase with the output of amplifier 60.

When the phase and amplitude controls are properly adjusted with no metallic object in the magnetic fields the output of summer 64 is approximately zero volts. Thus, when a lossy metallic object enters the magnetic field of the sensor 14, the null at the output of summer 64 becomes a 15 kHz sine wave with a phase that is subsequently detected by synchronous detector 66. This signal is low pass filtered 67 and subsequently triggers comparator 68 to produce a TRUE logic level at 70. If no wheel is present, wheel presence output 70 is logic level FALSE.

Figure 6:
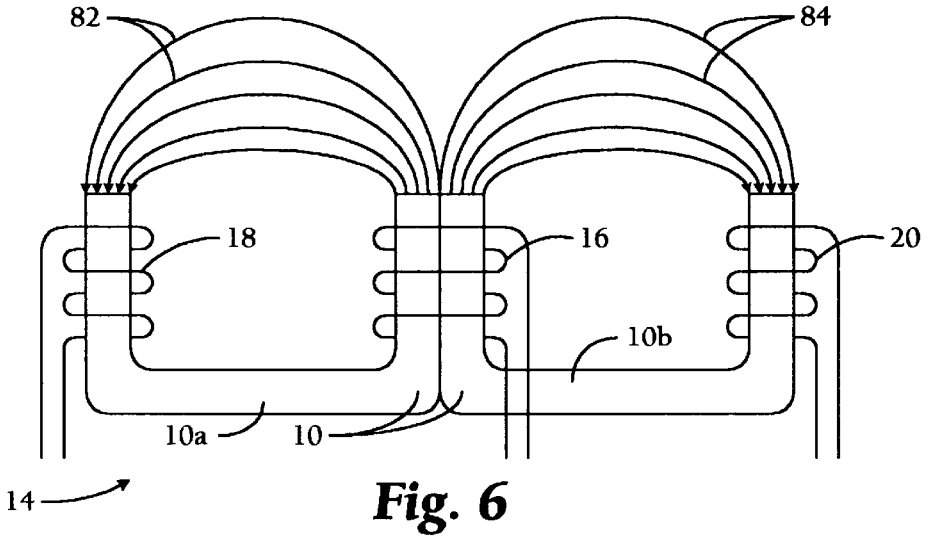
FIG. 6 is a diagrammatic view of an open E-core detection transformer showing magnetic force lines.
Figure 7:
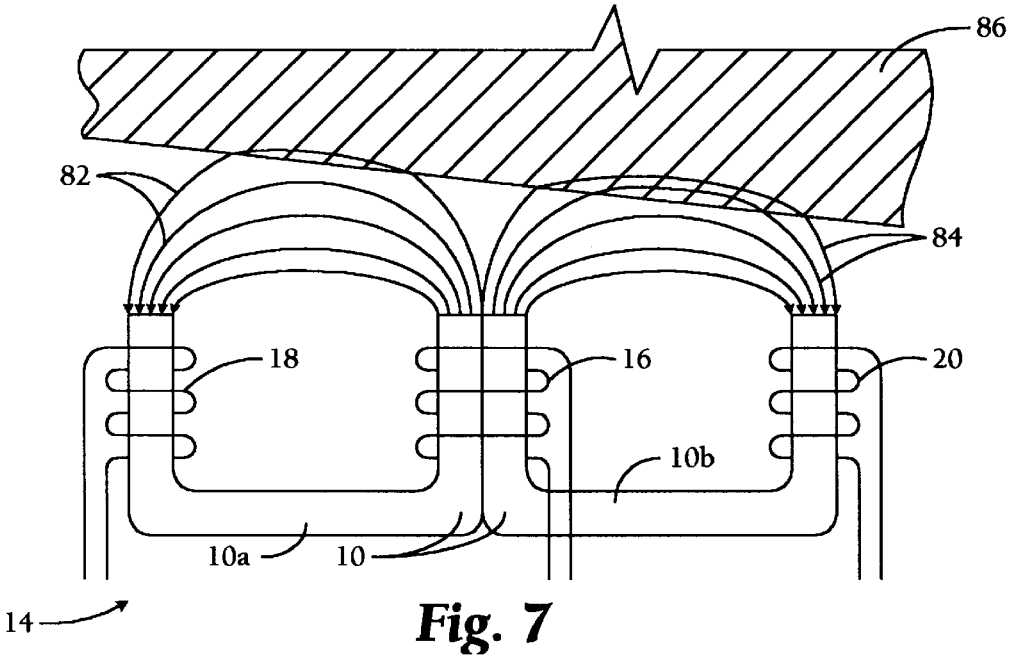
FIG. 7 is a diagrammatic view of an E-core detection transformer showing magnetic force lines in the presence of a train wheel.

FIG. 6 shows the magnetic lines of force that lie between the open pole faces of detection transformer 14. FIG. 7 shows that a wheel not centered over the transducer will have more lines of force passing through the wheel of one side of the field gap than the other. Thus, that side of sensor will have more eddy current and hysteresis losses than the other. This unbalances the sensor and the synchronous detector 36 detects the resultant signal vector.

The effect of the proximity of the rail to the sensor is shown in FIGS. 8 through 11. To maintain the balance and sensitivity of the sensor, it is necessary to adjust the position of the transformer assembly relative to the rail. The longitudinal axis of detection transformer 14 is secured parallel to rail head 80 and spaced directly below flange 88 of train wheel 86.

In operation, with no wheel present, exciter coil 16 produces magnetic lines of force 82 and 84 which induce nominally identical voltages in sensor coils 18 and 20, respectively, as shown in FIG. 6. Because sensor coils 18 and 20 are connected in series opposition, the signals are subtracted and the resultant output from synchronous voltage detector 36 is zero, resulting in FALSE outputs 42 and 44 (FIG. 5). When a wheel is present (as in FIG. 7), the difference in the volume of metal in the magnetic fields in each leg of the transformer is sufficient to unbalance the transformer so that the synchronous detector produces an average DC level change that is detected by one of the comparators.

Figure 12:
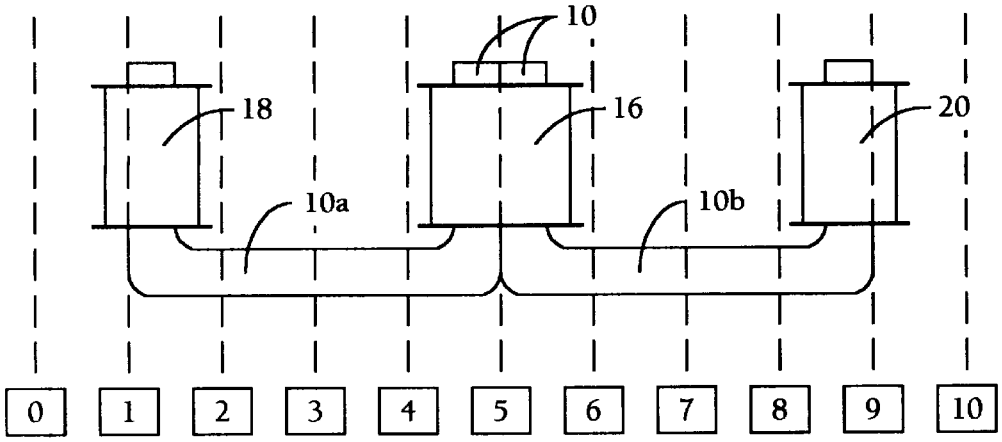
FIG. 12 is a diagram of an E-core detection transformer showing relative wheel positions.
Figure 13:
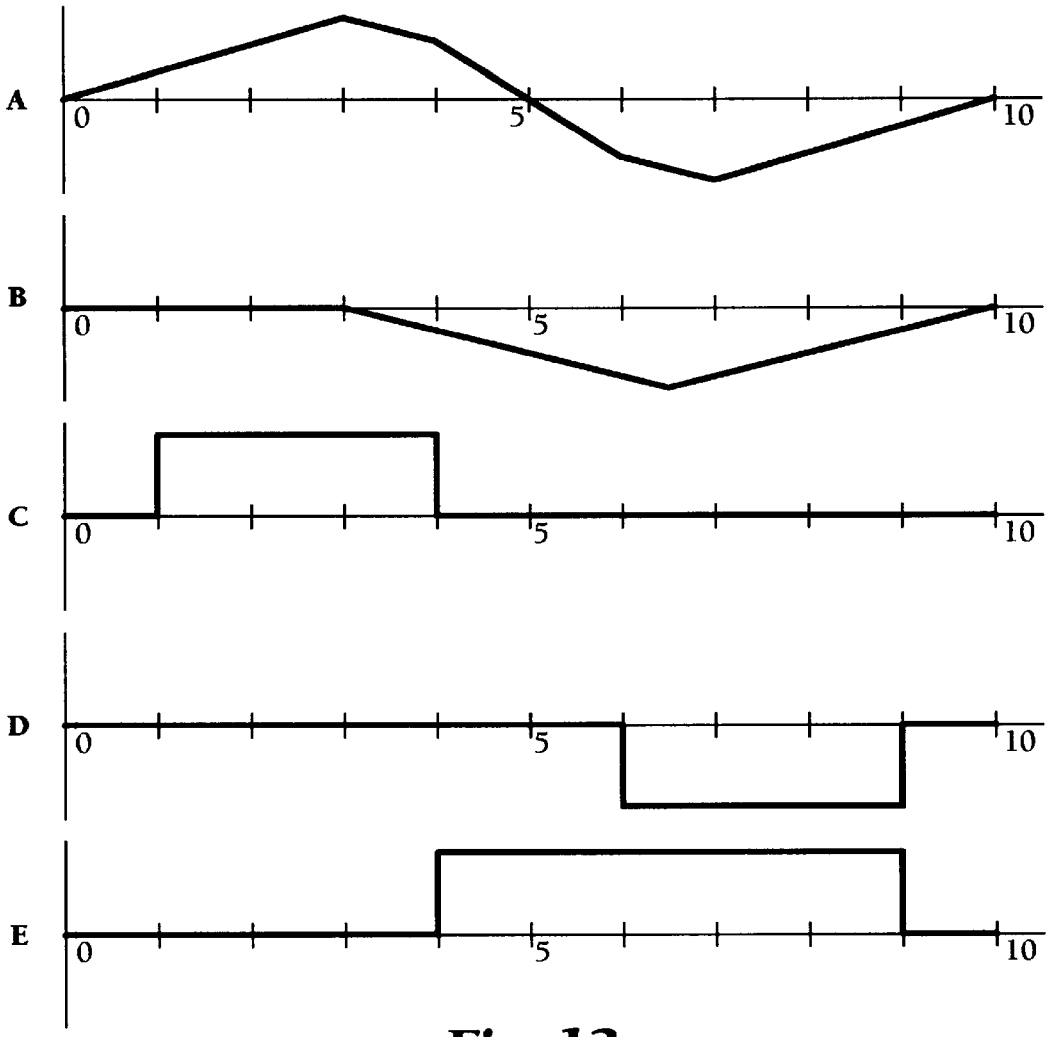
FIG. 13 comprises signal graphs showing outputs at various points on FIG. 5 as the wheel is moved through the positions of FIG. 12.

As a moving wheel travels from reference position 0 through reference position 10, as illustrated in FIG. 12, the waveforms shown in FIG. 13, at the corresponding points are generated at outputs A through E, referenced in FIG. 5. FIG. 13, signal A represents the waveform that appears at the output of low pass filtered signal from the synchronously detected signal from the balanced sensor coils as a function of time as a train wheel passes over the detection transformer. When this signal is impressed on comparators 38 and 40 waveforms C and D appear at the outputs of the respective comparators. If the train is traveling in a given direction to produce the waveform of A then the output of C occurs before the waveform of D. The speed of the train is indicated by the time between the leading edges of the two waveforms. If the train is traveling in the opposite direction then waveform D occurs before C and the direction is known. The speed of the train is also indicted by the time difference between the pulses. More accurate determination of the train speed can be accomplished by placing two of the zero speed sensors on a rail at an accurately known distance apart and measuring the time delay between the occurrence of either the two C pulses or the two D pulses.

When the wheel is at the center of the magnetic structure there is no signal from either comparator 38 or 40 (FIG. 13, waveforms C and D, position 5). However, output B of low pass filter 67 is no longer zero. Signal B is applied to comparator 68 whose output is shown in FIG. 13, signal E. Signal E is TRUE when the wheel stops at the magnetic center of the detection transformer. The wheel is shown to come to complete stop if a pulse is detected at C or D and it is not followed by a pulse at the D or C and at the same time E is TRUE.

The detection of the direction and position of the wheel is logically determined by the use of combinational logic, microprocessor-based logic, or sequential logic.

Having thus described the invention, what is claimed as new and desired to be secured by Letters Patent is as follows:

1. A transducer actuated by the presence of a metallic object comprising:

an inductive detector responsive to the presence of a lossy metallic object in its magnetic field and having an exciter coil, a pair of balanced sensing coils spaced therefrom each having an output voltage, and means connecting said sensing coils such that said coil output voltages are subtracted, means for positioning said detector adjacent to a path of travel of the object with said coils spaced along said path, means connected to said exciter coil for applying an alternating drive voltage thereto to produce a magnetic field inductively coupling the exciter coil with said sensing coils whereby, in the absence of a lossy metallic object in said magnetic field, no output is produced by the balanced sensing coils, a synchronous detector connected with said sensing coils and responsive to unbalancing of the magnetic field by the presence of a moving lossy metallic object for indicating the presence of the moving object and its direction of travel, and responsive to a zero speed lossy metallic object that causes unbalancing of the field, and means responsive to relative levels of the voltage applied to said exciter coil and a voltage across one of said sensing coils for determining the presence of a zero speed lossy metallic object located at a magnetic center of the field, whereby to indicate the presence of a stationary object at a location where the magnetic field is balanced.

2. The transducer as claimed in claim 1, wherein said inductive sensor includes an E-core having a center leg provided with said exciter coil and two outer legs provided with the respective sensing coils.

3. The transducer as claimed in claim 2, wherein each of said sensing coils and its associated leg is constructed and arranged to provide an induced voltage in response to the applied drive voltage that is equal to the induced voltage in the other sensing coil when no metallic object in the magnetic field of the transducer.

4. The transducer as claimed in claim 1, wherein said applied voltage has a phase and amplitude, and wherein said means for determining the presence of a zero speed object at said magnetic center includes means for modifying a sample of the phase and amplitude of said applied voltage and subtracting it from the voltage across said one sensing coil to produce a resultant null at an output when no metallic object is present, and means responsive to a resultant signal at said output for indicating that a zero speed metallic object is present.

5. A method of determining the presence of a metallic object at a predetermined location along a path of travel thereof, said method comprising the steps of:

providing an inductive detector having an exciter coil and a pair of balanced sensing coils spaced therefrom and presenting an output, positioning said detector adjacent to said path of travel with said coils spaced therealong, applying an alternating drive voltage to said exciter coil to produce a magnetic field inductively coupling the exciter coil with said sensing coils to provide a predetermined condition at said output indicative of the absence of a lossy metallic object in said magnetic field, detecting a change in said condition responsive to unbalancing of the magnetic field by the presence of a moving lossy metallic object to indicate the presence of the moving object and its direction of travel, and detecting a change in said condition in response to a zero speed lossy metallic object that causes unbalancing of the field, and sensing a relative phase and amplitude of said alternating drive voltage applied to said exciter coil and a voltage across one of said sensing coils to determine the presence of a zero speed lossy metallic object located at a magnetic center of the field, whereby to indicate the presence of a stationary object at a location where the magnetic field is balanced.

6. The method as claimed in claim 5, wherein said E-core comprises a pair of C-core sections presenting said center and outer legs, and wherein said method further comprises the step of calibrating the E-core by moving said sections relative to each other in a direction along said center leg to balance the sensing coils.

7. The method as claimed in claim 5, wherein said step of sensing the relative voltage levels, includes sampling and modifying the level of said applied voltage and subtracting the voltage across said one sensing coil to produce a resultant null at an output when no metallic object is present, and indicating that a zero speed lossy metallic object is present in response to a resultant signal at said output.

8. A wheel presence transducer comprising:

an inductive detector responsive to the presence of a lossy railway vehicle wheel and having an exciter coil, a pair of balanced sensing coils spaced therefrom, and means connecting said sensing coils in such a way that the output voltages are subtracted, means for positioning said detector adjacent one side of a rail with said coils spaced therealong, means connected to said exciter coil for applying an alternating drive voltage thereto to produce a magnetic field inductively coupling the exciter coil with said sensing coils whereby, in the absence of a lossy wheel in said magnetic field, no output is produced by the balanced sensing coils, a voltage detector connected with said sensing coils and responsive to unbalancing of the magnetic field by the presence of a moving lossy wheel for indicating the presence of the moving lossy wheel and its direction of travel, and responsive to a zero speed lossy wheel that causes unbalancing of the field, and means responsive to relative levels of said alternative drive voltage applied to said exciter coil and a voltage across one of said sensing coils for determining the presence of a zero speed lossy wheel located at a magnetic center of the field, whereby to indicate the presence of a stationary lossy wheel at a location where the magnetic field is balanced.

9. The transducer as claimed in claim 8, wherein said inductive detector includes an E-core having a center leg provided with said exciter coil and two outer legs provided with the respective sensing coils.

10. The transducer as claimed in claim 9, wherein each of said sensing coils and its associated leg is constructed and arranged to provide an induced voltage in response to the applied drive voltage equal to an induced voltage in the other sensing coil.

11. The transducer as claimed in claim 8, wherein said means for determining the presence of a zero speed lossy wheel at said magnetic center includes means for modifying the level of said applied voltage and the voltage across said one sensing coil to produce a resultant null at an output when no lossy wheel is present, and means responsive to a resultant signal at said output for indicating that a zero speed lossy wheel is present.

12. A method of determining the presence of a lossy railway vehicle wheel at a predetermined location along a rail, said method comprising the steps of:

providing an inductive detector having an exciter coil and a pair of balanced sensing coils spaced therefrom and presenting an output, positioning said detector adjacent to one side of a rail with said coils spaced therealong, applying an alternating drive voltage to said exciter coil to produce a magnetic field inductively coupling the exciter coil with said sensing coils to provide a predetermined condition at said output indicative of the absence of a lossy wheel in said magnetic field, detecting a change in said condition responsive to unbalancing of the magnetic field by the presence of a moving lossy wheel to indicate the presence of the moving lossy wheel and its direction of travel, and detecting a change in said condition in response to a zero speed lossy wheel that causes unbalancing of the field, and sensing relative levels of said alternating drive voltage applied to said exciter coil and a voltage across one of said sensing coils to determine the presence of a zero speed lossy wheel located at a magnetic center of the field, whereby to indicate the presence of a stationary lossy wheel at a location where the magnetic field is balanced.

13. The method as claimed in claim 12, wherein said E-core comprises a pair of C-core sections presenting said center and outer legs, and wherein said method further comprises the step of calibrating the E-core by moving said sections relative to each other in a direction along said center leg to balance the sensing coils.

14. The method as claimed in claim 12, wherein said step of sensing the relative voltage levels includes modifying a sample of the level of said applied voltage and the voltage across said one sensing coil to produce a resultant null at an output when no lossy wheel is present, and indicating that a zero speed lossy wheel is present in response to a resultant signal at said output.

* * * * *